United States Patent [19]

Schieber et al.

[11] 4,022,033

[45] May 10, 1977

[54] SHIFT DEVICE FOR THE NEEDLE BED OF A STRAIGHT KNITTING MACHINE

[75] Inventors: Hans Schieber; Erich Krause, both of Bopfingen, Germany

[73] Assignee: Universal Maschinenfabrik Dr. Rudolf Schieber KG, Westhausen, Germany

[22] Filed: Mar. 19, 1976

[21] Appl. No.: 668,383

[30] Foreign Application Priority Data

Mar. 26, 1975 Germany ..... 2513442

[52] U.S. Cl. ..... 66/69

[51] Int. Cl.[2] ..... D04B 7/00; D04B 7/20

[58] Field of Search ..... 66/69, 26

[56] References Cited

UNITED STATES PATENTS

| | | | |
|---|---|---|---|
| 218,318 | 8/1879 | Roscher | 66/69 X |
| 838,065 | 12/1906 | Whitcomb | 66/69 X |
| 1,468,513 | 9/1923 | Robalzynski | 66/69 |
| 1,992,982 | 5/1935 | Zippel | 66/69 |
| 3,477,254 | 11/1969 | Comas | 66/69 |
| 3,748,872 | 7/1973 | Hadam et al. | 66/69 |

*Primary Examiner*—Ronald Feldbaum
*Attorney, Agent, or Firm*—Sughrue, Rothwell, Mion, Zinn & Macpeak

[57] ABSTRACT

A shift device for the needle bed of a straight knitting machine comprises an indexing disc having a periphery movable substantially at right angles to the intended direction of shift of the needle bed and stoppable in selected positions. A plurality of eccentric indexing boss means adjustably mounted on the disc periphery for eccentric displacement about spindles extending radially of the disc, and a guide channel is securable to the needle bed oriented in the direction of the disc periphery. The width of the guide channel substantially corresponds to the diameter of each eccentric boss means and the eccentric boss means engage in the guide channel for establishing a predetermined shift of the guide channel substantially at right angles to the peripheral movement of the disc in accordance with the eccentricity of the boss means.

8 Claims, 6 Drawing Figures

SHIFT DEVICE FOR THE NEEDLE BED OF A STRAIGHT KNITTING MACHINE

The invention relates to a shift device for the needle bed of a straight knitting machine including an indexing disc the periphery of which is movable at right angles to the intended direction of shift of the needle beds and which can be stopped in different positions. On the periphery of the disc there are provided eccentrics which are displaceable about the axes extending radially with respect to the disc and which establish a given amount of shift as determined by each eccentric.

In a known shift device of this kind U.S. Pat. No. 3,748,872, peripheral faces of the eccentrics are let into blocks which in turn are displaceable in a channel formed in further blocks. The last-mentioned blocks are displaceable in the indexing disc in the direction of shift. By rotating the eccentrics, the channelled blocks, the side faces of which form parts of a shift cam, can be adjusted. However, the blocks and the channels formed therein are relatively expensive in production. The cost of production is further increased by the fact that the side faces and the channels in the blocks that help form the shift cam are formed at an acute angle to the direction of rotation of indexing disc. The elements used for converting this movement of the indexing disc into a shift movement of the needle beds are two bolts secured to the needle bed, between which the shift cam moves.

Acute-angled form of the side faces is accompanied by the further disadvantage that the indexing disc must be stopped in a very precise manner in the individual shift positions since even a slight deviation of the stop position from the required position causes the needle bed to be displaced through the shift cam.

Shift devices are also known wherein the shift cams do not have a continuous pitch but are stepped so that a zone of zero pitch is followed by a zone of greater pitch. Although precise setting of the indexing disc is not necessary with shift devices of this kind, the production of the shift cams is very expensive and complicated and cannot be achieved with the same degree of precision as can a shift cam having a pitch that is the same throughout all zones.

The present invention seeks to provide a shift device of the kind described by way of introduction, which can be produced with great precision using simple means, and which enables changes from one shift position to another to be made in a simple manner.

The present invention provides a shift device for the needle bed of a straight knitting machine comprising; an indexing disc having a periphery movable substantially at right angles to the intended direction of shift of the needle bed and stoppable in selected positions; a plurality of eccentric indexing boss means adjustably mounted on the disc periphery for eccentric displacement about spindles extending radially of the disc; and a guide channel securable to the needle bed orientated in the direction of the disc periphery and having a width which substantially corresponds to the diameter of each eccentric boss means, the eccentric boss means engaging in said guide channel for establishing a predetermined shift of the guide means substantially at right angles to the direction of peripheral movement of the disc in accordance with the eccentricity of the boss means.

The cost of production can be low since the device does not include guide blocks or the like. Even in the hardened condition, the eccentric boss means in the indexing disc can be formed in a considerably more precise manner and at lower cost than can particular pitches for the shift cam, the shift device of the invention having variable shift positions not only operates with high precision but is simpler to produce. The various shift stages can be established without the use of complicated means and in an efficient manner.

The eccentrics are advantageously spaced from each other by the same angle along the periphery of the indexing disc, and the indexing disc may suitably be firmly connected to a stop disc which has locking positions which are evenly spaced along its periphery to correspond with the spacing angles between the eccentrics. Thus, the indexing and stop means of the shift device have the same indexing distances in the direction of movement of the indexing disc for all the degrees of fineness of the straight or circular knitting machine.

Each eccentric boss means is advantageously provided with an attachment which is disposed eccentrically in relation to the outer periphery of the boss means and which is mounted in radial bore extending from the periphery of the indexing disc. A tightening screw may be screwed into the indexing disc through a bore in each eccentric boss means and through a concentric bore in each attachment. This arrangement ensures that the eccentric boss means are correctly mounted and secured in their set positions.

To enable the positions of the eccentric boss means to be readily adjusted, surfaces for engagement by a spanner are advantageously formed on each eccentric boss means to enable it to be displaced. After a tightening screw - screwed into the indexing disc - has been loosened, the eccentric boss means can be readily rotated, and then the tightening screw is tightened again with the eccentric boss means held fast, and the eccentric boss means is secured in position by means of clamps.

Markings for reading the position of the eccentric boss means can be provided on their peripheries so that their positions can be accurately set on a repetitive basis. The markings may be provided for example on the end face of each eccentric boss means and the position of the markings can be read with the aid of an associated pointer when the eccentrics are viewed from above.

Finally, the guide channel may have flat inclined guide faces in the zone of the inlet and outlet to ensure efficient setting of a shift position of the needle bed even when the shift movements are great.

A preferred embodiment of the invention is illustrated in the accompanying drawings and will now be described in detail. In the drawings.

Figure 6:
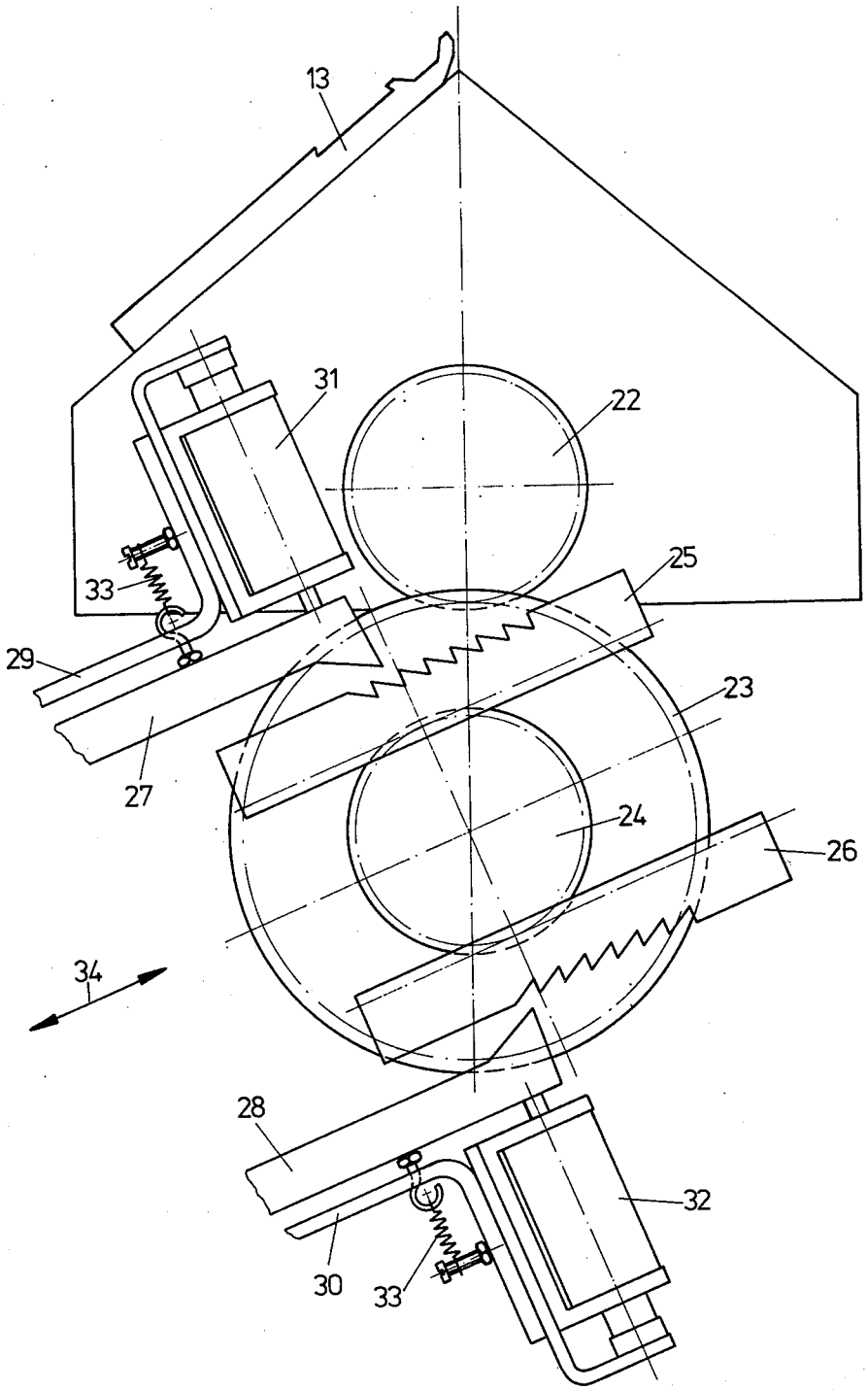
FIG. 6 is a side view of an indexing means for a shift device as illustrated in FIG. 1.

The shift device illustrated in the drawings includes an indexing disc 2 and a stop disc 3 which are firmly interconnected and mounted for rotation on a shift 1. The indexing disc 2 is actuated by a known indexing means such as is illustrated in FIG. 6 and described hereinafter. Eccentrically mounted indexing bosses 4 are mounted on tangential faces formed on the periphery of the indexing disc 2, the number of these eccentric bosses corresponding to the required number of shift positions of the needle bed. Whereas in FIGS. 1 and 2, only four eccentric bosses 4 are illustrated, twelve to eighteen eccentrics are generally provided, which corresponds to a possibility of shifting the needle bed by a distance equal to six needle pitches at maximum.

Each eccentric boss 4 has an attachment peg 5 formed thereon eccentrically with respect to the circular periphery of the boss. The attachment peg 5 is precisely located in a complementary bore in the indexing disc 2. A bore is formed to extend through each eccentric boss 4 and each attachment peg 5 and a comping screw 6 is screwed through the bore into the indexing disc 2 concentrically with each attachment peg 5.

The attachment pegs 5 associated with each pair of adjacent eccentric bosses 4 and located in the bores in the indexing disc 2 are separated from each other by predetermined shift distances *a* or *b* at right angles to the direction of movement of the indexing disc 2, i.e. in the direction of the axis of the disc and of the shift of the needle bed 13. The shift distance *a* illustrated in FIG. 2 corresponds to one needle pitch, whereas the shift distance *b* corresponds to a needle bed shift that has to be made in order to reach a stitch transfer position of the needle bed. The shift distances *a* and *b* differ according to the degree of fineness of the straight or circular knitter and they correspond to the difference between one basic shift position and another, and between a basic position and a stitch transfer position. In a third median position the shift distance from a basic position is a *a*/2. In such a position the needles lie exactly opposite each other so that they can form a knitted fabric having a 1 :1 ratio for example.

Figure 1:
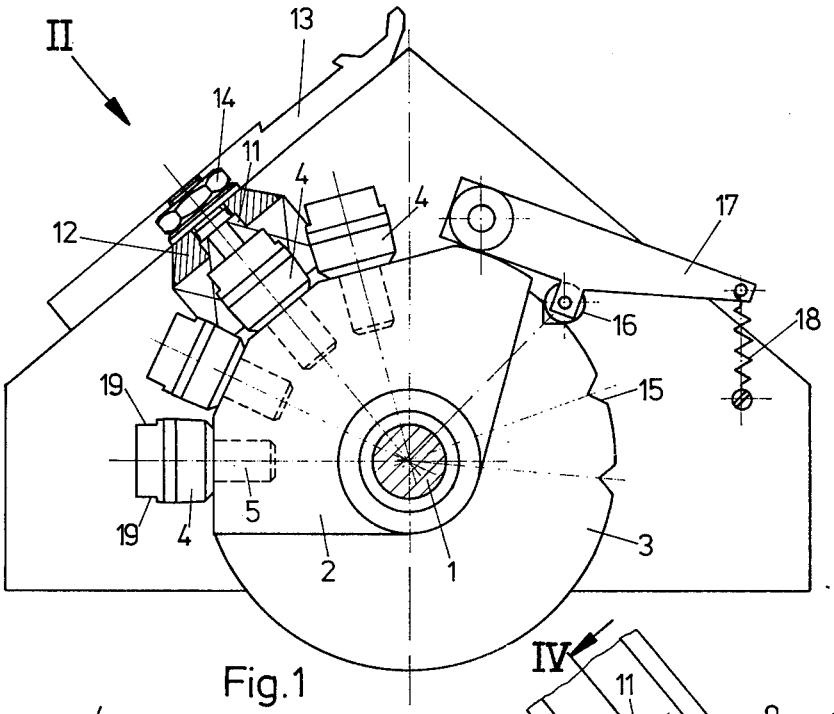
FIG. 1 is a side view, partly in cross-section, of a straight knitting machine and shows the main parts of the shift device embodying the invention.

As clearly shown in FIG. 1, the eccentric bosses 4 are arranged at the same angular distances apart from each other along the periphery of the indexing disc 2. Thus, the indexing distances of the indexing disc 2 and of the stop disc 3 connected thereto are the same in the direction of the indexing movement of the indexing disc 2 for all degrees of fineness of the straight or circular knitter.

Figure 2:
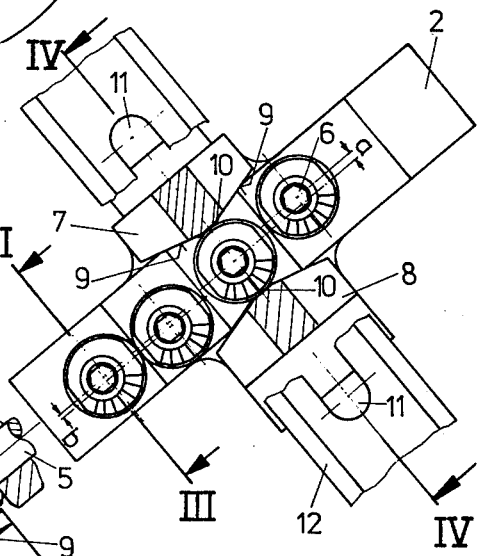
FIG. 2 is a plan view, partly in cross-section, of the shift device of FIG. 1 seen in the direction of the arrow II.
Figure 3:
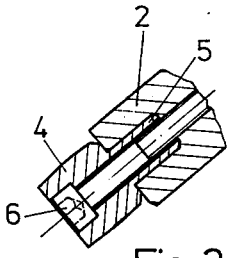
FIG. 3 is a cross-section through an indexing boss along the line III—III of FIG. 2.
Figure 4:
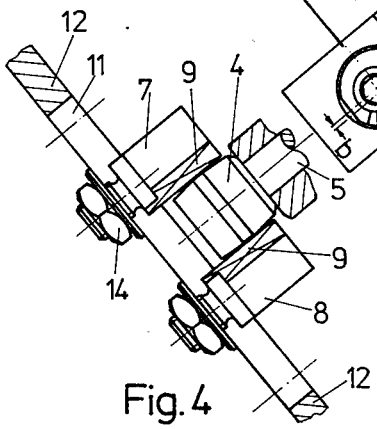
FIG. 4 is a cross-section, along line IV—IV of FIG. 2, through a guide strip for a needle bed comprising an indexing boss located between two indexing cams.

It can be seen from FIG. 2 that each of the eccentric bosses 4 is located between two indexing cams 7 and 8. The indexing cams 7 and 8 are so formed that they have a flat lead face 9 on each side and in the middle they are each provided with a face 10 which is parallel to the opposing face 10 of the other indexing cam. By means of the flat lead faces 9, the eccentric bosses 4 are able to achieve large shifts during the movement of the indexing disc 2, whereas the mutually parallel faces 10 on opposite indexing cams 7 and 8 ensure accurate positioning of the shifted needle bed in a locking position. The parallel free faces 10 form the side walls of a guide channel.

The two indexing cams 7 and 8 are displaceably mounted in a slot 11 in a guide strip 12 which is secured to the needle bed 13 and these cams are clamped in the slot by nuts 14 on the guide strip 12.

The stop disc 3, which is firmly secured to the indexing disc 2, has at its periphery a series of notches 15 which are spaced apart by the same angular distances as are the eccentric bosses 4 on the indexing disc, and which correspond to the indexing positions of the eccentric bosses 4. The indexing position of a selected eccentric boss 4 is held by the engagement of a roller 16 in an associated notch 15. The roller 16 is rotatably mounted on a stop lever 17 which is biased by a spring 18 towards the stop disc 3.

Figure 5:
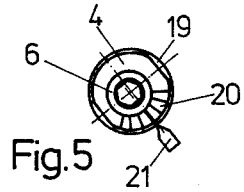
FIG. 5 is a plan view of an indexing boss and shows markings and a pointer.

Each eccentric boss 4, which is mounted in an eccentric position can be turned in order to adjust the various shift positions when different materials are used and when a given pattern of the knitted piece has been set. For this purpose the clamping screw 6 is loosened and the eccentric boss 4 is gripped with a tool on its faces 19 and is turned. As clearly shown in FIG. 5, a scale 20 is provided on the end face of each eccentric boss 4, and the position of the eccentric 4 can be read on this scale with the aid of a pointer 21. After the eccentric 4 has been adjusted it is secured in position again by tightening the clamping screw 6.

FIG. 6 illustrated diagrammatically an indexing device for the stepwise movement of the indexing disc 2. A toothed gear 22 is secured to the indexing disc 2 and the stop disc 2. Meshing with the gear 22 is a further gear 23 which is connected to a gear 24. Two racks 25 and 26, which are disposed parallel to each other, engage the gear or pinion 24. On that of their sides which is remote from the gear 24 the racks 25 and 26 have locking teeth along which move indexing pawls 27 and 28 provided on a slide, not illustrated. The indexing pawls 27 and 28 move backwards and forwards in synchronism with the straight or circular knitter in the direction indicated by the double-headed arrow 34 in FIG. 6.

Also secured to the slide not represented, on which the two indexing pawls 27 and 28 are mounted, are holders 29 and 30 for electrically controlled selector magnets 31 and 32. The pawls 27 and 28 are normally kept disengaged from the racks 25 and 26 by springs 23. As soon as one of the two selector magnets 31 and 32 is switched on by a control system of the machine, the magnet presses the indexing pawl 27 or 28 associated therewith, against a locking tooth on the rack 25 or 26, so that the movement of the associated indexing pawl 27 or 28 is transmitted to the racks 25 and 26 respectively.

When the pawl 27 engages the rack 25 as a result of the selector magnet 31 being switched on, the gears 24 and 23 are rotated in the clockwise direction, and the gear 22 in the counter-clockwise direction as seen in FIG. 6, so that the indexing disc 2 and the stop disc 3 are also correspondingly rotated. If, however, the pawl 28 engages the rack 26 as a result of the selector magnet 32 being switched on, the gears 24 and 23 are rotated in the counter-clockwise direction as shown in FIG. 6 and the gear 22 is rotated in the clockwise direction so that the direction of rotation of the indexing disc 2 and the stop disc 3 is reversed.

We claim:

1. A shift device for the needle bed of a straight knitting machine comprising; an indexing disc having periphery movable substantially at right angles to the intended direction of shift of the needle bed and stoppable in selected positions; a plurality of eccentric indexing boss means adjustably mounted on the disc periphery for eccentric displacement about spindles extending radially of the disc; and a guide channel securable to the needle bed oriented in the direction of the disc periphery and having a width which substantially corresponds to the diameter of each eccentric boss means, the eccentric boss means engaging in said guide channel for establishing a predetermined shift of the guide means substantially at right angles to the direction of the peripheral movement of the disc in accordance with the eccentricity of the boss means.

2. A shift device as claimed in claim 1, in which the eccentric boss means are equiangularly spaced from each other along the periphery of the indexing disc and the indexing disc is firmly connected to a stop disc which has locking positions which are evenly spaced along its periphery to correspond with the spacing angles between the eccentric boss means.

3. A shift device as claimed in claim 1, in which each of the eccentric boss means has an attachment means which is disposed eccentrically with respect to an outer periphery of the boss means and which fits accurately in a radial bore in the periphery of the indexing disc.

4. A shift device as claimed in claim 3, including a clamping screw for securing each eccentric boss means in its set position, the clamping screw being screwed into the indexing disc through a bore in the eccentric boss means and through a concentric bore in the attachment means associated with each eccentric boss means.

5. A shift device as claimed in claim 1, in which faces engageable by a spanner are provided on each eccentric boss means to enable the eccentric boss means to be displaced.

6. A shift device as claimed in claim 1, including a marking provided on the periphery of each eccentric boss means to enable the position of the eccentric boss means to be observed.

7. A shift device as claimed in claim 6, in which the markings are provided on end faces of each eccentric boss means.

8. A shift device as claimed in claim 1, in which the guide channel has flat inclined lead faces in an inlet and outlet zone.

* * * * *